US005327498A

United States Patent [19]

Hamon

[11] Patent Number: 5,327,498

[45] Date of Patent: Jul. 5, 1994

[54] PROCESSING DEVICE FOR SPEECH SYNTHESIS BY ADDITION OVERLAPPING OF WAVE FORMS

[75] Inventor: Christian Hamon, Dinan, France

[73] Assignee: Ministry of Posts, Tele-French State Communications & Space, Dinan, France

[21] Appl. No.: 487,942

[22] PCT Filed: Sep. 1, 1989

[86] PCT No.: PCT/FR89/00438

§ 371 Date: Nov. 15, 1990

§ 102(e) Date: Nov. 15, 1990

[87] PCT Pub. No.: WO90/03027

PCT Pub. Date: Mar. 22, 1990

[30] Foreign Application Priority Data

Sep. 2, 1988 [FR] France ..... 88 11517

[51] Int. Cl.[5] ..... G10L 5/00

[52] U.S. Cl. ..... 381/51

[58] Field of Search ..... 381/51-53; 395/2

[56] References Cited

U.S. PATENT DOCUMENTS

| | | | |
|---|---|---|---|
| 4,398,059 | 8/1983 | Lin et al. | 381/51 |
| 4,833,718 | 5/1989 | Sprague | 381/52 |
| 4,852,168 | 7/1989 | Sprague | 381/52 |

OTHER PUBLICATIONS

Charpentier et al, "Diphone Synthesis etc." IEEE-ICASSP 86, Tokyo, pp. 2015-2018.

Makhoul et al, "Time-Scale Modification etc." IEEE-ICASSP 86, Tokyo, pp. 1705-1708.

*Primary Examiner*—Emanuel S. Kemeny

*Attorney, Agent, or Firm*—Larson and Taylor

[57] ABSTRACT

A process of speech synthesis from diphones stored in a dictionary as waveforms, for text-to-speech conversion, comprises supplying a sequence of phoneme codes and respective prosodic information, and, for each phoneme, analyzing and synthesizing each phoneme, and then concatenating the synthesized phonemes. For each phoneme, two diphones are selected among the stored diphones and the presence of voicing is determined. For voiced phonemes, the respective waveforms of the two diphones constituting the phoneme are filtered by a window which is centered on a point of the selected waveform representative of the beginning of a pulse response of vocal cords to excitation thereof. The window has a width substantially equal to twice the greater of the original fundamental period and the fundamental synthesis period and has an amplitude progressively decreasing from the center of the window. The signals resulting from the filtering and obtained for each diphone are time shifted so as to be spaced apart by a time equal to the fundamental synthesis period. Synthesis is achieved by adding the displaced overlapping signals.

8 Claims, 4 Drawing Sheets

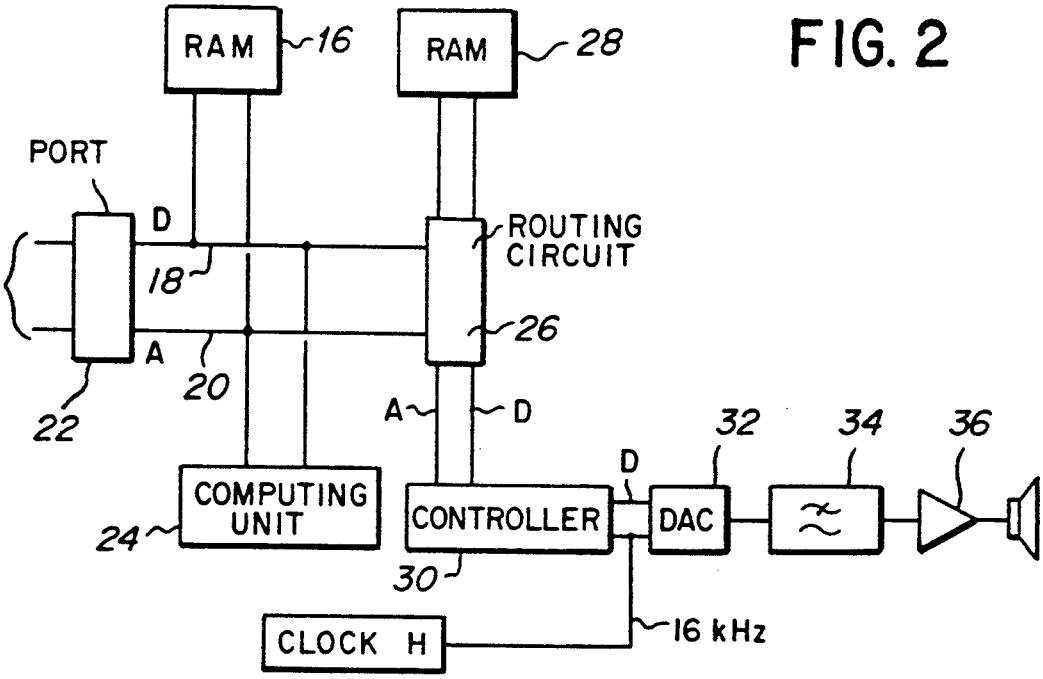
FIG. 2
FIG. 5
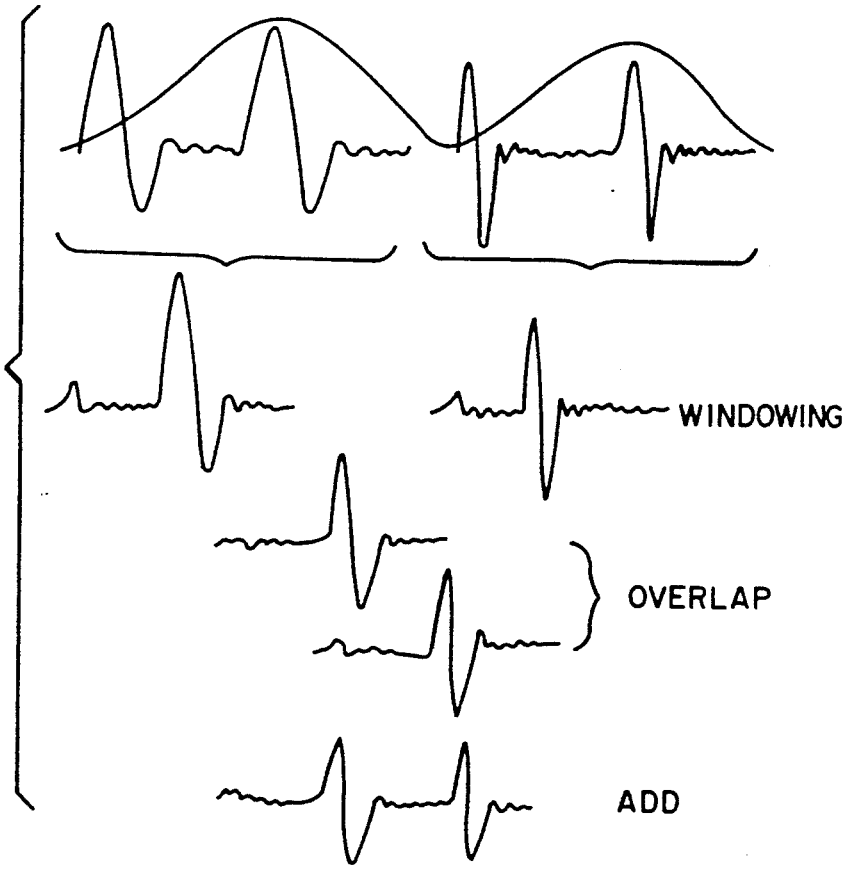

PROCESSING DEVICE FOR SPEECH SYNTHESIS BY ADDITION OVERLAPPING OF WAVE FORMS

BACKGROUND OF THE INVENTION

The invention relates to methods and devices of speech synthesis; it relates more particularly to synthesis from a dictionary of sound elements (also known as component sounds) by fractionating the text to be synthesized into microframes each identified by an order number of a corresponding sound element and by prosodic parameters (information concerning sound height at the beginning and at the end of the sound element and duration of the sound element), then by adaptation and concatenation of the sound elements by an adding overlapping procedure.

The sound elements stored in the dictionary will frequently be diphones, i.e. transitions between phonemes, which makes it possible, for the French language, to make to with a dictionary of about 1300 sound elements; different sound elements may however be used, for example, syllables or even words. The prosodic parameters are determined as a function of criteriae relating to the context; the sound height which corresponds to the intonation depends on the position of the sound element in a word and in the sentence and the duration given to the sound element depends on the rythm of the sentence.

It should be recalled that speech synthesis methods are divided into two groups. Those which use a mathematic model of the vocal tract (linear prediction synthesis, formant synthesis and fast Fourier transform synthesis) rely on a deconvolution of the source and of the transfer function of the vocal tract and generally require about 50 arithmetic operations per digital sample of the speech before digital-analog conversion and restoration.

This source-vocal duct deconvolution makes it possible to modify the value of the fundamental frequency of the voiced sounds, namely sounds which have a harmonic structure and are caused by vibration of the vocal cords, and compression of the data representing the speech signal.

Those which belong to the second group of processus use time-domain synthesis by concatenation of wave forms. This solution has the advantage of flexibility in use and the possibility of considerably reducing the number of arithmetic operations per sample. On the other hand, it is not possible to reduce the flow rate required for transmission as much as in the methods based on a mathematic model. But this drawback does not exist when good restoration quality is essential and there is no requirement to transmit data over a narrow channel.

Speech synthesis according to the present invention belong to the second group. It finds a particularly important application in the field of transformation of an orthographic chain (formed for example by the text delivered by a printer) into a speech signal, for example restored directly delivered or transmitted over a normal telephone line.

A speech synthesis process from sound elements using a short term signal add-overlap technique is already known (Diphone synthesis using an overlap-add technique for speech waveforms concatenation, Charpentier et al, ICASSP 1986, IEEE-IECEJ-ASJ International Conference on Acoustics Speech and Signal Processing, pp. 2015–2018). But it relates to short term synthesis signals with standardization of the overlap of the synthesis windows, obtained by a very complex procedure:

- analysis of the original signal by synchronous windowing of the voicing;
- Fourier transform of the short-term signal;
- envelope detection;
- homothetic transformation of the frequential axis on the spectrum of the source;
- weighing of the modified source spectrum by the envelope of the original signal;
- reverse Fourier transform.

SUMMARY OF THE INVENTION

It is a main object of the present invention to provide a relatively simple process making acceptable reproduction of speech possible. It starts from the assumption that voiced sounds may be considered as the sum of the impulse responses of a filter, stationary for several milliseconds, (corresponding to the vocal tract) excited by a Dirac succession, i.e. by a "pulse comb", synchronously with the fundamental frequency of the source, namely of the vocal cords, which causes a harmonic spectrum in the spectral field, the harmonics being spaced apart from the fundamental frequency and being weighted by an envelope having maxima called formants, dependent on the transfer function of the vocal tract.

It has already been proposed (Micro-phonemic method of speech synthesis, Lacszewic et al, ICASSP 1987, IEEE, pp. 1426–1429) to effect speech synthesis in which the reduction of the fundamental frequency of the voiced sounds, when it is required for complying with prosodic data, is effected by insertion of zeroes, the microphonemos stored having then obligatorily to correspond to the maximum possible height of the sound to be restored, or else (U.S. Pat. No. 4,692,941) to reduce the fundamental frequency similarly by insertion of zeroes, and to increase it by reducing the size of each period. These two methods introduce in the speech signal not inconsiderable distorsions during modification of the fundamental frequency.

An object of the present invention is to provide a synthesis process and device with concatenation of waveforms not having the above limitation and making it possible to supply good quality speech, while only requiring a small volume of arithmetic calculations.

For this, the invention particularly provides a process characterized in that:

at least on the voiced sound of the sound elements, windowing is carried out centered on the beginning of each pulse response of the vocal tract to excitation of the vocal cords (this beginning being possibly stored in a dictionary) with a window having a maximum for said beginning and an amplitude decreasing to zero at the edge of the window; and the windowed signals corresponding to each sound element are moved by a time shift equal to the fundamental synthesis period to be obtained, lesser or greater than the original fundamental period depending on the prosodic height information of the fundamental frequency and the signals are summed.

These operations form the overlap add procedure applied to the elementary waveforms obtained by windowing of the speech signal.

Generally, sound elements constituted of diphones will be used.

The width of the window may vary between values which are smaller or greater than twice the original period. In the embodiment which will be described further on, the width of the window is advantageously chosen equal to about twice the original period in the case of increasing the fundamental period or about twice the final synthesis period in the case of increasing the fundamental frequency, so as to partially compensate for the energy modifications due to the change of the fundamental frequency, not compensated for by possible energy standardization taking into account the contribution of each window to the amplitude of the samples of the synthesized digital signal: in the case of a reduction of the fundamental period, the width of the window will therefore be less than twice the original fundamental period. It is not desirable to go below this value.

Because it is possible to modify the value of the fundamental frequency in both directions, the diphones are stored with the natural fundamental frequency of the speaker.

With a window having a duration equal to two consecutive fundamental periods in the "voiced" case, elementary waveforms are obtained whose spectrum represents the envelope of the speech signal spectrum or wideband short term spectrum—because this spectrum is obtained by convolution of the harmonic spectrum of the speech signal and of the frequency response of the window, which in this case has a bandwidth greater than the distance between harmonics—; the time redistribution of these elementary waveforms will give a signal having substantially the same envelope as the original signal but a modified between harmonics distance.

With a window having a duration greater than two fundamental periods, elementary waveforms are obtained whose spectrum is still harmonic, or narrow band short term spectrum—because then the frequency response of the window is narrower than the distance between harmonics—; the time redistribution of these elementary waveforms will give a signal having, like the preceding synthesis signal, substantially the same envelope as the original signal except that reverberation terms will have been introduced (signals whose spectrum has a lower amplitude, a different phase, but the same shape as the amplitude spectrum of the original signal), whose effect will only be audible if the window width exceeds about three periods, this echoing effect not degrading the quality of the synthesis signal when its amplitude is low.

A Hanning window may typically be used, although other window forms are also acceptable.

The above-defined processing may also be applied to so-called "surd" or non-voiced sounds, which may be represented by a signal whose form is related to that of a white noise, but without synchronization of the windowed signals: this is to homogeneize the processing of the surd sounds and the voiced sounds, which makes possible on the one hand smoothing between sound elements (diphones) and between surd and voiced phonemes, and on the other hand modification of the rythm. A problem arises at the junction between diphones. A solution for overcoming this difficulty consists in omitting extraction of elementary waveforms from two adjacent fundamental transition periods between diphones (in the case of surd sounds, the voicing marks are replaced by arbitrarily placed marks): it will be possible either to define a third elementary wave function by computing the average of the two elementary wave functions extracted on each side of the diphone, or to use the add-overlap procedure directly on these two elementary wave functions.

The invention will be better understood from the following description of a particular embodiment of the invention, given by way of non-limitative example. The description refers to the accompanying drawings.

BRIEF DESCRIPTION OF THE DRAWINGS

FIG. 2 is a block diagram showing a possible construction of the synthesis device implanted on a host computer;

FIG. 5 is a graph showing a principle of attenuating discontinuities between diphones;

DETAILED DESCRIPTION OF THE INVENTION

Synthesis of a phoneme is effected from two diphones stored in a dictionary, each phoneme being formed of two half-diphones. The sound "é" in "période" for example will be obtained from the second half-diphone of "pai" and from the first half-diphone of "air".

Figure 1:
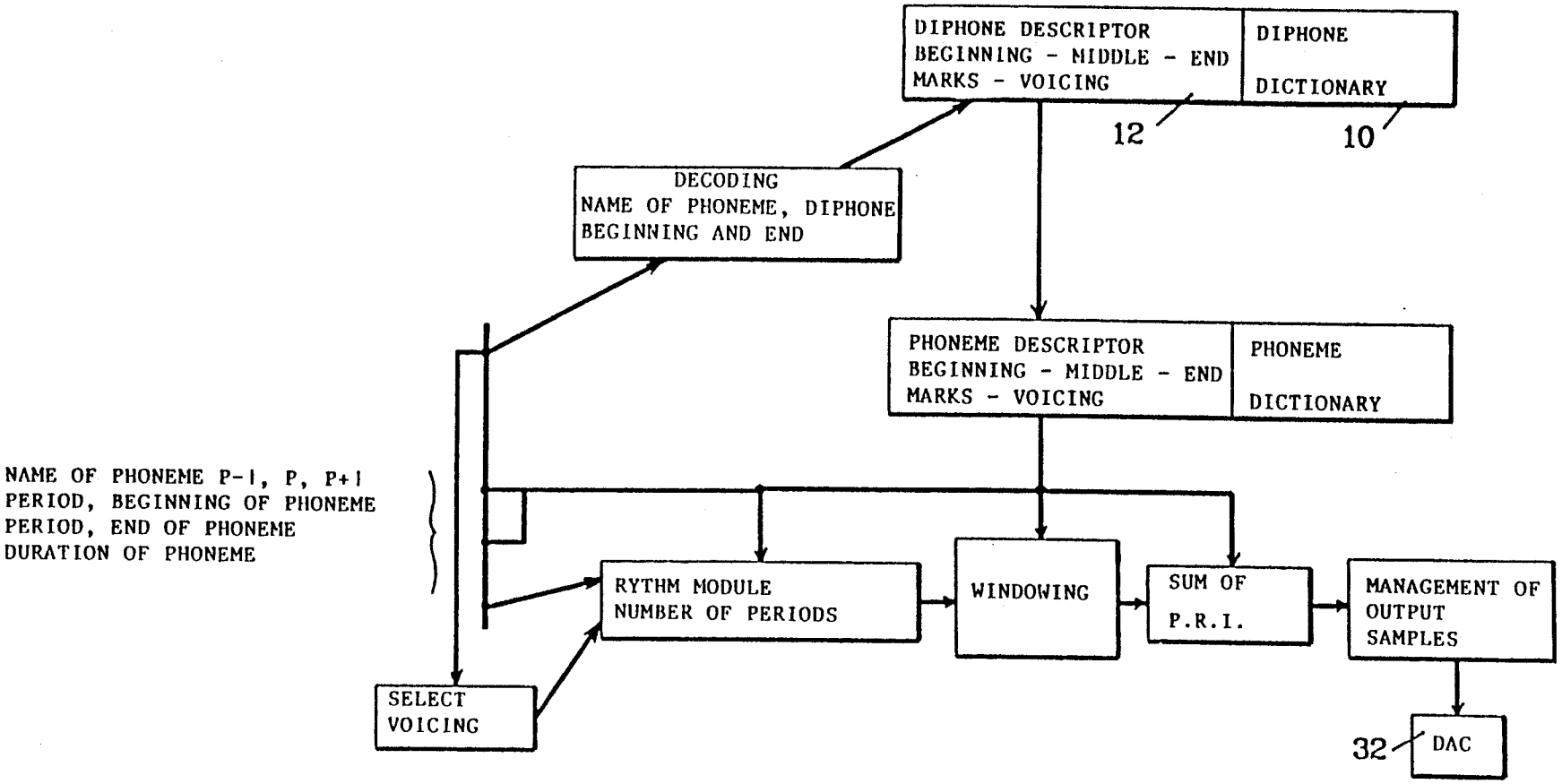
FIG. 1 is a graph illustrating speech synthesis by concatenation of diphones and modification of the prosodic parameter in the time domain, in accordance with the invention.

A module for orthographic phonetic translation and computation of the prosody (which does not form part of the invention) delivers, at a given time, data identifying:

the phoneme to be restored, of order P
the preceding phoneme, of order P−1
the following phoneme, of order P+1 and giving the duration to be assigned to the phoneme P as well as the periods at the beginning and at the end (FIG. 1).

A first analysis operation, which is not modified by the invention, consists in determining the two diphones selected for the phoneme to be used and voicing, by decoding the name of the phonemes and the prosodic indications.

All available phonemes (1300 in number for example) are stored in a dictionary 10 having a table forming the descriptor 12 and containing the address of the beginning of each diphone (in a number of blocks of 256 bytes), the length of the diphone and the middle of the diphone (the last two parameters being expressed as a number of samples from the beginning) and voicing marks indicating the beginning of the response of the vocal tract to the excitation of the vocal cords in the case of a voiced sound (35 in number for example). Diphone dictionaries complying with such criteria are available for example from the Centre National d'Etudes des Telecommunications.

The diphones are then used in an analysis and synthesis process shown schematically in FIG. 1. This process will be described assuming that it is used in a synthesis device having the construction shown in FIG. 2, intended to be connected to a host computer, such as the central processor of a personal computer. It will also be assumed that the sampling frequency giving the representation of the diphones is 16 kHz.

The synthesis device (FIG. 2) then comprises a main random access memory 16 which contains a computing microprogram, the diphone dictionary 10 (i.e. waveforms represented by samples) stored in the order of the addresses of the descriptor, table 12 forming the dictionary descriptor, and a Hanning window, sampled for example over 500 points. The random access memory 16 also forms a microframe memory and a working memory. It is connected by a data bus 18 and an address bus 20 to a port 22 of the host computer.

Each microframe emitted for restoring a phoneme (FIG. 2) consists for each of the two phonemes P and P+1 which intervene of the serial number of the phoneme, of the value of the period at the beginning of the phoneme, of the value of the period at the end of the phoneme, and of the total duration of the phoneme, which may be replaced by the duration of the diphone for the second phoneme.

The device further comprises, connected to buses 18 and 20, a local computing unit 24 and a routing circuit 26. The latter makes it possible to connect a random access memory 28 serving as output buffer either to the computer, or to a controller 30 of an output digital-analog converter 32. The latter drives a low pass filter 34, generally limited to 8 kHz, which drives a speech amplifier 36.

Operation of the device is the following.

The host computer (not shown) loads the microframes in the table reserved in memory 16, through port 22 and buses 18 and 20, then it initiates synthesis by the computing unit 24. This computing unit searches for the number of the current phoneme P, of the following phoneme P+1 and of the preceding phoneme P+1 in the microframe table, using an index stored in the working memory, initialized at 1. In the case of the first phoneme, the computing unit searches only for the numbers of the current phoneme and of the following phoneme. In the case of the last phoneme, it searches for the number of the preceding phoneme and that of the current phoneme.

In the general case, a phoneme is formed of two half-diphones; the address of each diphone is sought by matrix-addressing in the descriptor of the dictionary by the following formula:

number of the diphone descriptor = number of the first phoneme + (number of the second phoneme − 1)*number of diphones.

Voiced sounds

The computing unit loads, into the working memory 16, the address of the diphone, its length, its middle as well as the 35 voicing marks. It then loads, in a descriptor table of the phoneme, the voicing marks corresponding to the second part of the diphone. Then it searches, in the waveform dictionary, for the second part of the diphone, which it places in a table representing the signal of the analysis phoneme. The marks stored in the phoneme descriptor table are down-counted by the value of the middle of the diphone.

This operation is repeated for the second part of the phoneme formed by the first part of the second diphone. The voicing marks of the first part of the second diphone are added to the voicing marks of the phoneme and incremented by the value of the middle of the phoneme.

In the case of voiced sounds, the computing unit, form prosodic parameters (duration, period at the beginning and period at the end of the phoneme) then determines the number of periods required for the duration of the phoneme, from the formula:

number of periods = 2*duration of the phoneme/(beginning period + end period).

The computing unit stores the number of marks of the natural phoneme, equal to the number of voicing marks, then determines the number of periods to be removed or added by computing the difference between the number of synthesis periods and the number of analysis periods, which difference is determined by the modification of tonality to be introduced from that which corresponds to the dictionary.

For each synthesis period selected, the computing unit then determines the analysis period selected among the periods of the phoneme from the following considerations:

modification of the duration may be considered as causing correspondance, by deformation of the time axis of the synthesis signal, between the n voicing marks of the analysis signal and the p marks of the synthesis signal, n and p being predetermined integers;

with each of the p marks of the synthesis signal must be associated the closest mark of the analysis signal.

Duplication or, conversely elimination of periods spread out regularly over the whole phoneme modifies the duration of the latter.

It should be noted that there is no need to extract an elementary wavefrom from the two adjacent transition periods between diphones: the add-overlap operation of the elementary functions extracted from the last two periods of the first diphone and from the first two periods of the second diphone permit smoothing between these diphones, as shown in FIG. 5.

For each synthesis period, the computing unit determines the number of points to be added to or omitted from the analysis period by computing the difference between the latter and the synthesis period.

Figure 3:
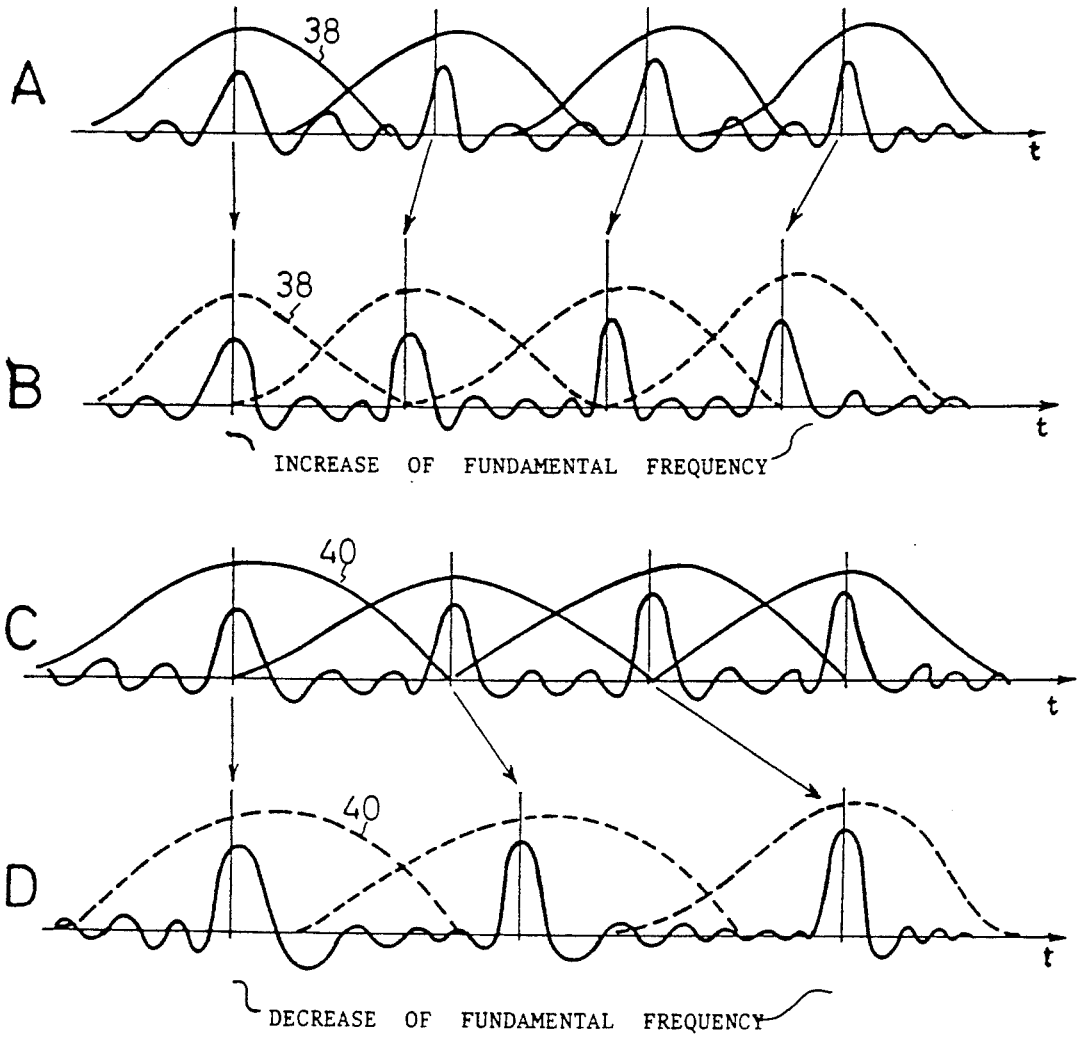
FIG. 3 shows, by way of example, how the prosodic parameters of a natural signal are modified in the case of a particular phoneme.

As was mentioned above, it is advantageous to select the width of the analysis window in the following way, illustrated in FIG. 3:

if the synthesis period is lesser than the analysis period (lines A and B in FIG. 3), the size of window 38 is twice the synthesis period;

in the opposite case, the size of window 40 is obtained by multiplying by 2 the smallest of the values of the current analysis period and of the preceding analysis period (lines C and D).

The computing unit defines an advance step in reading the values of the window, tabulated for example over 500 points, the step then being equal to 500 divided by the size of the window previously computed. It reads out of the analysis phoneme signal buffer memory 28 the samples of the preceding period and of the current period, weights them by the value of the Hanning window 38 or 40 indexed by the number of the current sample multiplied by the advance step in the tabulated window and progressively adds the computed values to the buffer memory of the output signal, indexed by the sum of the counter of the current output sample and of the search index of the samples of the analysis phoneme. The current output counter is then incremented by the value of the synthesis period.

Surd sounds (not voiced)

For surd phonemes, the processing is similar to the preceding one, except that the value of the pseudo-periods (distance between two voicing marks) is never modified: elimination of the pseudo-periods in the center in the phoneme simply reduces the duration of the latter.

The duration of surd phonemes is not increased, except by adding zeros in the middle of the "silence" phonemes.

Windowing is effected for each period for standardizing the sum of the values of the windows applied to the signal:

from the beginning of the preceding period to the end of the preceding period, the advance step in reading the tabulated window is (in the case of tabulation over 500 points) equal to 500 divided by twice the duration of the preceding period;

from the beginning of the current period to the end of the current period, the advance step in the tabulated window is equal to 500 divided by twice the duration of the current period plus a constant shift of 250 points.

When computation of the signal of a synthesis phoneme is ended, the computing unit stores the last period of the analysis and synthesis phoneme in the buffer memory 28 which makes possible transition between phonemes. The current output sample counter is decremented by the value of the last synthesis period.

The signal thus generated is fed, by blocks of 2048 samples, into one of two memory spaces reserved for communication between the computing unit and the controller 30 of the D/A converter 32. As soon as the first block is loaded into the first buffer zone, the controller 30 is enabled by the computing unit and empties this first buffer zone. Meanwhile, the computing unit fills a second buffer zone with 2048 samples. The computing unit then alternately tests those two buffer zones by means of a flag for loading therein the digital synthesis signal at the end of each sequence of synthesis of the phoneme. Controller 30, at the end of reading out of each buffer zone, sets the corresponding flag. At the end of synthesis, the controller empties the last buffer zone and sets an end-of-synthesis flag which the host computer may read via the communication port 22.

Figure 4A:
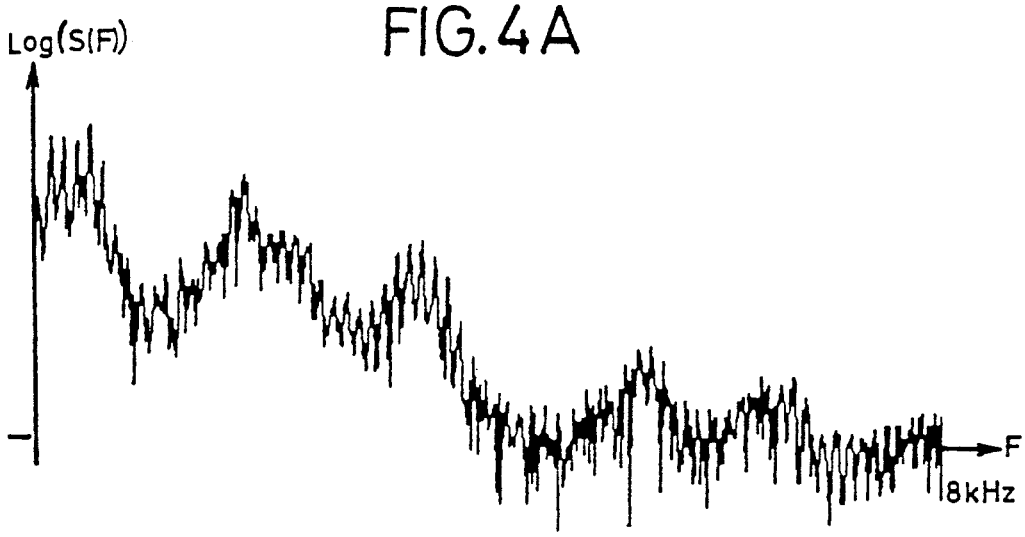
FIG. 4A, 4B and 4C are graphs showing spectral modifications made to voiced synthesized signals, FIG. 4A showing the original spectrum, FIG. 4B the spectrum with reduction of the fundamental frequency and FIG. 4C the spectrum with increase of this frequency.
Figure 4B:
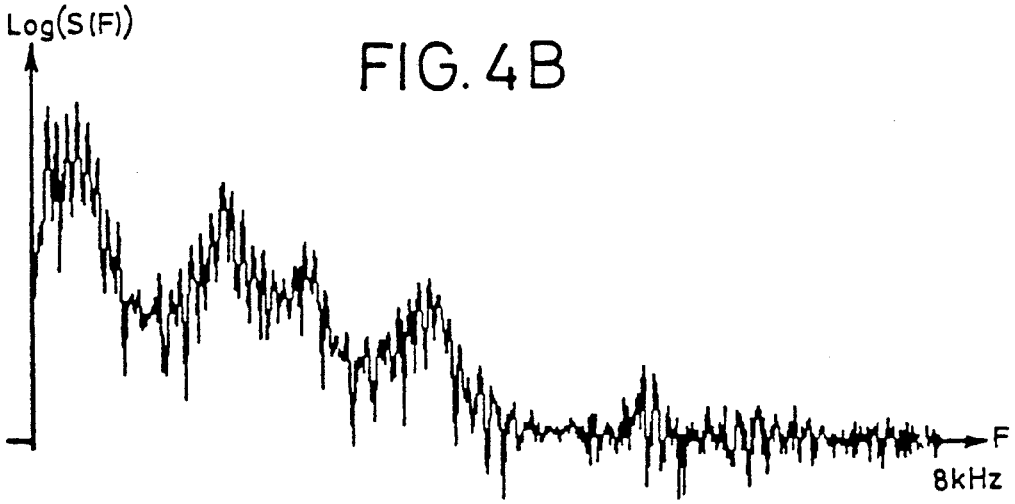
Figure 4C:
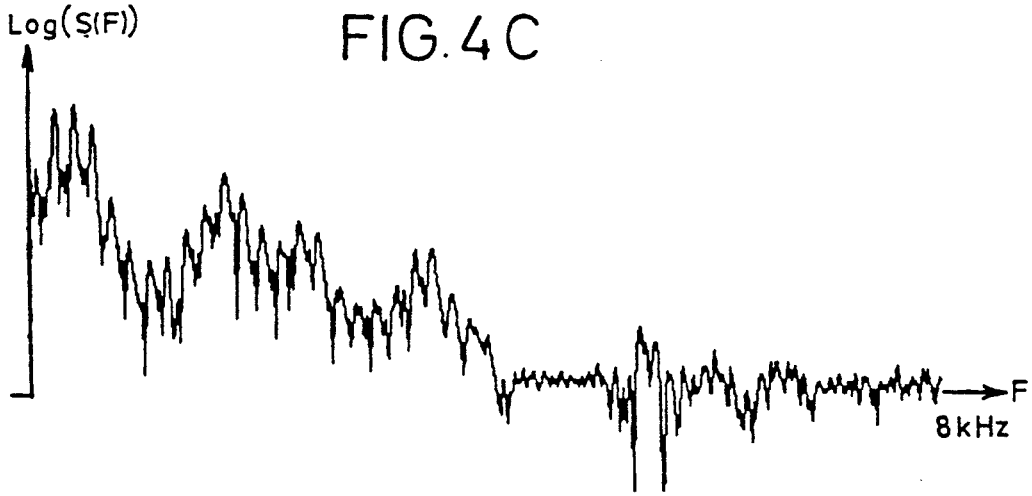

The example of analysis and synthesis of voiced speech signal spectrum illustrated in FIGS. 4A–4C shows that the transformations in time of the digital speech signal do not affect the envelope of the synthesis signal, while modifying the distance between harmonics, i.e. the fundamental frequency of the speech signal.

The complexity of computation remains low: the number of operations per sample is on average two multiplications and two additions for weighting and summing the elementary functions supplied by the analysis.

Figure 6:
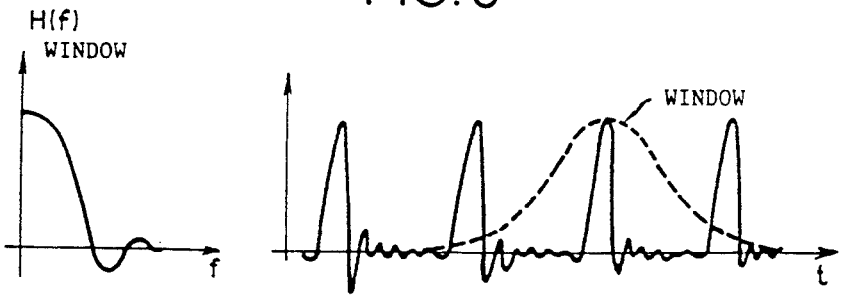
FIG. 6 is a diagram showing the windowing over more than two periods.

Numerous modified embodiments of the invention are possible and, in particular, as mentioned above, a window of a width greater than two periods, as shown in FIG. 6, possibly of fixed size, may give acceptable results.

It is also possible to use the process of modifying the fundamental frequency over digital speech signals outside its application to synthesis by diphones.

I claim:

1. Process of speech synthesis from diphones stored in a dictionary as waveforms, for text-to-speech conversion, comprising: supplying a sequence of phoneme codes and respective prosodic information including the original fundamental period at the beginning and at the end of the phoneme and the duration thereof, and, for each phoneme, analysing and synthesizing each phoneme; and then concatenating the synthesized phonemes;

wherein said analysis comprises, for each phoneme, selecting two diphones among the stored diphones and determining the presence of voicing, characterized in that said analysis further includes, for voiced phonemes, subjecting the respective waveforms of the two diphones constituting the phoneme to filtering by a window having a predetermined position with respect to the waveform so selected that the window be centered on a point of the waveform representative of the beginning of a pulse response of vocal cords to excitation thereof, said window having a width substantially equal to twice the lesser of said original fundamental period and the fundamental synthesis period and having an amplitude progressively decreasing from the center of the window to zero at the edges thereof, and displacing the signals resulting from said filtering and obtained for each diphone with such a time shift that they are spaced apart by a time equal to the fundamental synthesis period, and characterized in that synthesis is achieved by adding the displaced overlapping signals.

2. Process of speech synthesis from diphones stored in a dictionary as waveforms, for text-to-speech conversion, comprising: supplying a sequence of phoneme codes and respective prosodic information, including the original fundamental period at the beginning and at the end of the phoneme and the duration thereof; for each phoneme, analysing said phoneme and synthesizing said phoneme with fundamental synthesis periods as indicated by said prosodic information; and then concatenating the synthesized phonemes;

wherein said analysis comprises, for each phoneme, using a diphone descriptor for selecting two diphones among the stored diphones and determining the presence of voicing, characterized in that said analysis further includes, for voices phonemes, subjecting the respective waveforms of the two diphones constituting the respective phoneme to filtering by a window having a predetermined position with respect to the waveform so selected that the window be centered on a point of the waveform representative of the beginning of the pulse response of vocal cords to excitation, said window having a width substantially equal to twice the lesser of said original fundamental period and the fundamental synthesis period and having an amplitude progressively decreasing from the center of the window to zero at the edges thereof, and redistributing the mutually overlapping signals resulting from said filtering and obtained for each diphone with such a time spacing that they are spaced by a time equal to the fundamental synthesis period, and characterized in that synthesis is achieved by adding the displaced overlapping signals.

3. Process according to claim 2, comprising the further preliminary step of fractionating the text to be synthesized into digital microframes each identified by the serial number of a corresponding phoneme in a dictionary diphone storing said waveforms.

4. Speech synthesis process according to claim 1, characterized in that the window is a Hanning window.

5. Speech synthesis process according to claim 1, wherein the width of said window does not exceed three times the synthesized period.

6. Speech synthesis process according to claim 2, wherein the descriptor is arranged for determining the address of each diphone for a first and a second phoneme as number of the diphone descriptor = number of the first phoneme + (number of the second phoneme − 1)*number of diphones.

7. Speech synthesis process according to claim 2, characterized in that transition between successive diphones is achieved by computing the average of two elementary wave signals extracted from each side of the diphone.

8. A digital speech synthesis device for text-to-speech conversion, comprising, connected to data and address buses:

main RAM memory means containing:

a diphone dictionary containing waveforms each stored as a plurality of samples, and each representing one of a plurality of diphones, a dictionary descriptor table including for each diphone and at a respective address, data identifying the beginning of the diphone, the length of the diphone, the middle of the diphone and voicing marks, said waveforms being stored in said dictionary in the order of the respective addresses in the dictionary descriptor table, a filtering Hanning window in sampled form, a computation micro-program, and a table space reserved for receiving successive microframes each representative of a phoneme and each including serial numbers of a diphone in said dictionary and prosodic information relating to said phoneme comprising at least the fundamental periods at the beginning and at the end of the phoneme to be synthesized; a local computing unit operating responsive to said micro-program and arranged for reading out, from said descriptor table, the identifying data of the two respective voiced diphones of each phoneme identified in turn by one of said microframes, for subjecting the respective waveforms to filtering by said Hanning window sampled for giving it a width substantially equal to twice the synthesized period as given by the respective microframe, for redistributing signals resulting from filtering of the respective waveforms with a period equal to the fundamental synthesis period and for adding the redistributed signals;

a buffer memory;

a routing circuit for alternatively connecting an input of said buffer memory to an output of the computing unit and an output of said buffer memory to an output digital/analog converter through a controller; and a speech amplifier driven by said digital/analog converter.

* * * * *